US006756861B2

(12) United States Patent
Rosenberg et al.

(10) Patent No.: US 6,756,861 B2
(45) Date of Patent: Jun. 29, 2004

(54) JUNCTION FOR ORTHOGONALLY ORIENTED WAVEGUIDES

(75) Inventors: Uwe Rosenberg, Backnang (DE); Werner Speldrich, Backnang (DE)

(73) Assignee: Marconi Communications GmbH, Backnang (DE)

( * ) Notice: Subject to any disclaimer, the term of this patent is extended or adjusted under 35 U.S.C. 154(b) by 0 days.

(21) Appl. No.: 09/895,018

(22) Filed: Jun. 28, 2001

(65) Prior Publication Data

US 2002/0021184 A1 Feb. 21, 2002

(30) Foreign Application Priority Data

Jul. 1, 2000 (DE) ..... 100 32 172

(51) Int. Cl.[7] ..... H01P 5/12
(52) U.S. Cl. ..... 333/125; 333/122; 333/21 A
(58) Field of Search ..... 333/125, 21 A, 333/21 R, 122, 261

(56) References Cited

U.S. PATENT DOCUMENTS

| | | | | |
|---|---|---|---|---|
| 2,668,191 A | * | 2/1954 | Cohn | 333/21 A |
| 2,729,794 A | * | 1/1956 | Cohn | 333/21 A |
| 2,742,612 A | * | 4/1956 | Cohn | 333/21 R |
| 2,921,274 A | | 1/1960 | Dascotte | |
| 2,960,671 A | | 11/1960 | Ohm | |
| 2,975,383 A | * | 3/1961 | Seling | 333/21 A |
| 3,178,660 A | | 4/1965 | Smith | |
| 6,087,908 A | * | 7/2000 | Haller et al. | 333/122 |

FOREIGN PATENT DOCUMENTS

DE 42 34 532 A1 4/1994

OTHER PUBLICATIONS

Ihmels, et al., *Field Theory CAD of L–shaped Iris Coupled Mode Launchers and Dual–Mode Filters*, Microwave Symposium Digest, 1993., IEEE, US, Jun. 14, 1993, pp. 765–768.

Bornemann, J., et al., *Edge–Conditioned Vector Basis Functions for the Analysis and Optimization of Rectangular Waveguide Dual–Mode Filters*, 1999 IEEE MTT–S, International Microwave Symposium Digest, (IMS), Anaheim, CA, Jun. 13–19, 1999, Jun. 1999, pp. 1695–1698.

Beyer, R., et al., *Field–Theory Design of Circular Waveguide Dual–Mode Filter By A Combined Mode–Matching Finite Element Method*, 24$^{th}$, European Microwave Conference Proceedings, Cannes, Sep. 5–8, 1994, Nexus Business Communications, GB, pp. 294–303.

Rosenberg, U., et al., *A Compact and Broadbane 90–Degree Waveguide Twist Transformer for Integrated Waveguide Subsystems*, Proc. 31$^{st}$ European Microwave Conf., London, UK, Sep. 2001, vol. 1, pp. 204–208.

* cited by examiner

*Primary Examiner*—Robert Pascal
*Assistant Examiner*—Dean Takaoka
(74) *Attorney, Agent, or Firm*—Kirschstein, et al.

(57) ABSTRACT

A junction for orthogonally oriented waveguides including a transformation stage which has a first oblong opening for connecting a first waveguide which is designed to carry a first ground wave type, and a second oblong opening for connecting a second waveguide which is designed to carry a second ground wave type. The first oblong opening and the second oblong opening are oriented orthogonally with respect to each other. The transformation stage has an essentially right-angled geometry with a height, a width and a depth, where the height and the width are chosen such that both the first ground wave type and the second ground wave type are propagated in the transformation stage.

16 Claims, 5 Drawing Sheets

JUNCTION FOR ORTHOGONALLY ORIENTED WAVEGUIDES

Figure 1:
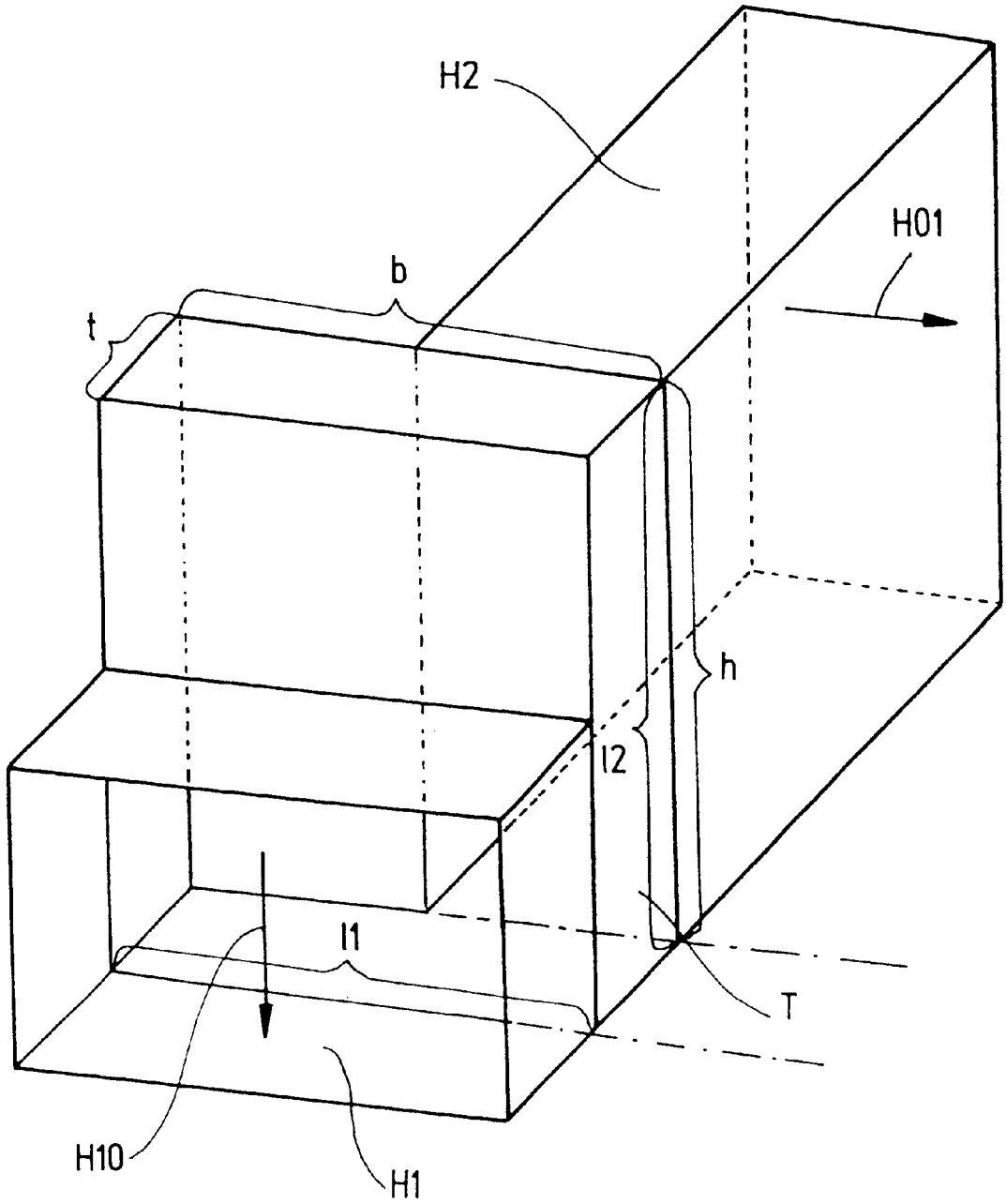

The present invention pertains to a junction for orthogonally oriented waveguides, with a transformation stage containing a first oblong opening for connecting a first waveguide which is designed to carry a first type of ground wave, and having a second oblong opening for connecting a second waveguide which is designed to carry a second type of ground wave, where the first oblong opening and the second oblong opening are oriented orthogonally with respect to each other.

BACKGROUND OF THE INVENTION

The known junctions of this type are realized, for example, by means of a combination of several waveguide segments which are rotated with respect to each other. A description of a junction of this type is found, for example, in the "Taschenbuch der Hochfrequenztechnik (Pocket Manual of High Frequency Technology), Meinke/Grundlach, 2nd edition, pages 399 ff." The production of such a junction from several waveguide segments is very expensive, however, and an additional problem is that junctions of this type cannot be used in so-called integrated waveguide circuits which are realized using the half-shell technique.

An additional junction of this type which could be produced in principle using the half-shell technique is known from EP 0392999B1. This publication pertains to a field-rotating waveguide junction in waveguides for electromagnetic microwaves, where the junction has at one of its ends a quasi-rectangular cross section of the desired height and width, with the shape of the cross section differing from rectangular by a fin which projects into the junction from one side of the cross section in the height direction of the cross section, and where the junction has at its other end a rectangular cross section with one long side and one short side. EP 0392999B1 provides for the waveguide junction to have a first part which extends from one end of the quasi-rectangular cross section to a central segment with L-shaped cross section, and a second part which extends from the central segment to the other end of the rectangular cross section; the height extension of the fin which projects inward at the one end of the waveguide junction is oriented in essentially the same direction as the long side of the rectangular cross section at the other end of the waveguide junction; and the dimension of the L-shaped central segment is smaller on one side of the fin than the quasi-rectangular cross section, and on the other side of the fin its dimension is greater by a corresponding degree than that of the quasi-rectangular cross section in the height direction of the inward-projecting fin. The junction in accordance with EP 0392999B1 is also assembled from several waveguide segments with various cross section geometries. The production of this junction is expensive, however, and the necessary overall length of the construction is relatively great, which is disadvantageous in particular in conjunction with integrated waveguide circuits.

SUMMARY OF THE INVENTION

The fact that the junction according to the invention provides for the transformation stage to have an essentially right-angled geometry with a height, a width and a depth, where the height and the width are chosen such that both the first type of ground wave and the second type of ground wave can be propagated in the transformation stage, creates a compact, easily manufactured junction of relatively small overall length which matches the ground wave types of two orthogonally oriented waveguides across a broad range of frequencies with little reflection. The construction according to the invention causes the formation of a hybrid wave type in the transformation stage, by means of which a transformation between the first ground wave type and the second ground wave type is achieved. The junction according to the invention can be integrated for example as a subcomponent in planar waveguide circuits. Because of the rotation of polarization which is possible within a total structure with the junction according to the invention, with complex integrated waveguide circuits the optimal installation position and coupling can be achieved for each component. In spite of the short overall length which is possible with the junction according to the invention, very good electrical properties are attained over a very broad range of frequencies. In addition, because of the very short possible overall length, a very compact overall structure can be achieved with complex integrated waveguide circuits, for example with the distributor networks for array antennas described in EP 0392999B1 mentioned at the beginning, where several of the junctions of this type are needed. By preference there is provision for the transformation stage to have a length or depth $\leqq(2n+1)\lambda/4$, with n=0, 1, 2, 3 . . . , where $\lambda$ is the waveguide wavelength of the H10 or H01 wave type in the area of the transformation stage. Such a length or depth of the junction according to the invention makes possible optimal transport of energy, where the shortest and preferred possible length or depth is approximately $\lambda/4$. In particular if the width and height of the transformation stage have similar dimensions, the corresponding threshold wavelengths $\lambda_{iH01}$ and $\lambda_{iH10}$, and thus the waveguide wavelengths of the wave types H10 and H01 in the area of the transformation stage, are similar. With $\lambda_{H01}\approx\lambda_{H10}$, the length of the transformation stage is then $t\leqq(\lambda_{H01}+\lambda_{H10})/8\approx\lambda_{H10}/4\approx\lambda_{H01}/4$. Furthermore, $\lambda$ can be the mean waveguide wavelength of the useful frequency band of the first and second waveguides.

The first oblong opening is preferably located in the front face of the transformation stage, and the second oblong opening is preferably located in the rear face of the transformation stage.

At the same time, the first oblong opening can be positioned horizontally in the upper or lower part of the front face of the transformation stage.

With certain implementations, the length of the first oblong opening can correspond approximately to the width of the transformation stage. This makes particularly good sense when the first waveguide is connected to the transformation stage directly, that is, without an intervening shield and without an additional transformation stage.

The second oblong opening is preferably positioned vertically in the left or right area of the rear face of the transformation stage. Particularly good results are obtained if the second oblong opening is positioned immediately adjacent to the left or right edge of the rear face of the transformation stage.

In certain variants, the length of the second oblong opening can correspond approximately to the height of the transformation stage. This solution suggests itself in turn when the second waveguide is connected to the transformation stage directly, that is, without an additional transformation stage.

To increase the bandwidth, in certain variants of the junction according to the invention there can be provision for the first opening to be connected to an additional transformation stage which is provided for connecting the first waveguide.

In that case, the additional transformation stage can be arranged symmetrically to the cross section of the first waveguide and asymmetrically to the transformation stage. Variants are also conceivable, however, in which the additional transformation stage is arranged with an entirely different symmetry or asymmetrically, depending on the overall construction.

If an additional transformation stage is employed, its width can be smaller than that of the transformation stage.

Naturally, it is also conceivable for an additional opening to be associated also, or only, with the second opening.

Furthermore it is conceivable for the first opening to be combined with a first shield which is provided for connecting the first waveguide. This first shield can also contribute to increasing the bandwidth of the junction.

Although this is not absolutely necessary, the width of the first shield can be smaller than the width of the transformation stage, depending on the transmission performance desired.

To further enlarge the bandwidth, the second opening can be combined with a second shield which is provided to connect the second waveguide.

The width of the second shield can then be smaller than the height of the transformation stage.

Since the junction according to the invention can be realized by means of the half-shell technique, it can be manufactured in a simple manner, for example by a milling procedure.

Furthermore, the junction according to the invention can be formed by an integrated waveguide circuit, or can be a component of such an integrated waveguide circuit.

The first waveguide and the second waveguide can have different cross section dimensions, if appropriate. For example, on one side a standard waveguide could be connected (width: height≈1:2), and on the other side a waveguide with reduced width (width: height≈1:4). In this connection it is also conceivable for the first and the second waveguides to be formed by two different standard waveguides with differing ground wavelengths. The cross section of the waveguides does not need to be exactly right-angled, but rather rounded right angle geometries; elliptical waveguides can also be used.

The asymmetrical arrangement of the waveguides, which is common to the various implementations, causes the formation of a hybrid wave type in the transformation stage, which brings about the transformation.

BREIF DESCRITPION OF THE DRAWINGS

The invention is explained in greater detail below on the basis of the associated drawings.

Figure 2:
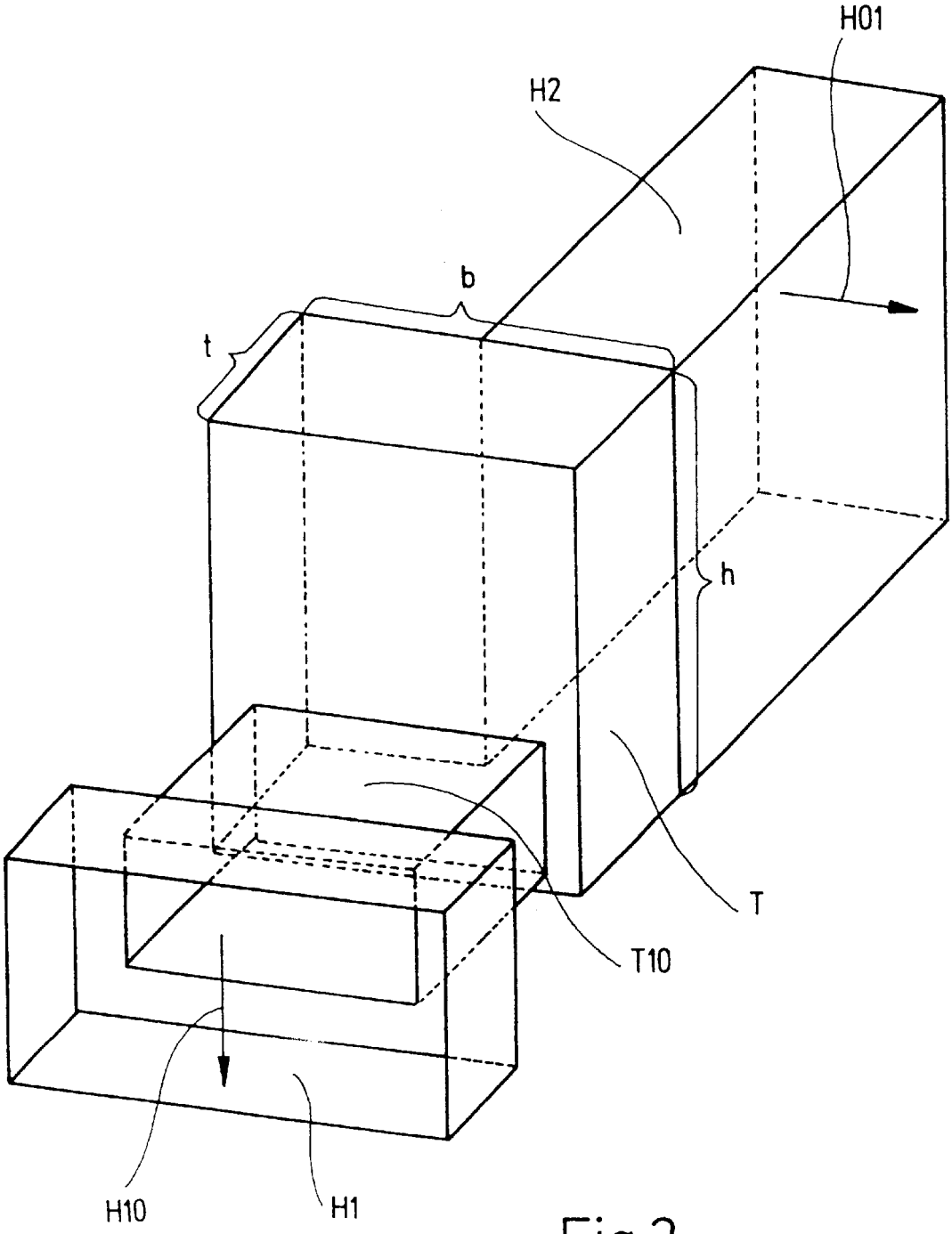
Figure 3:
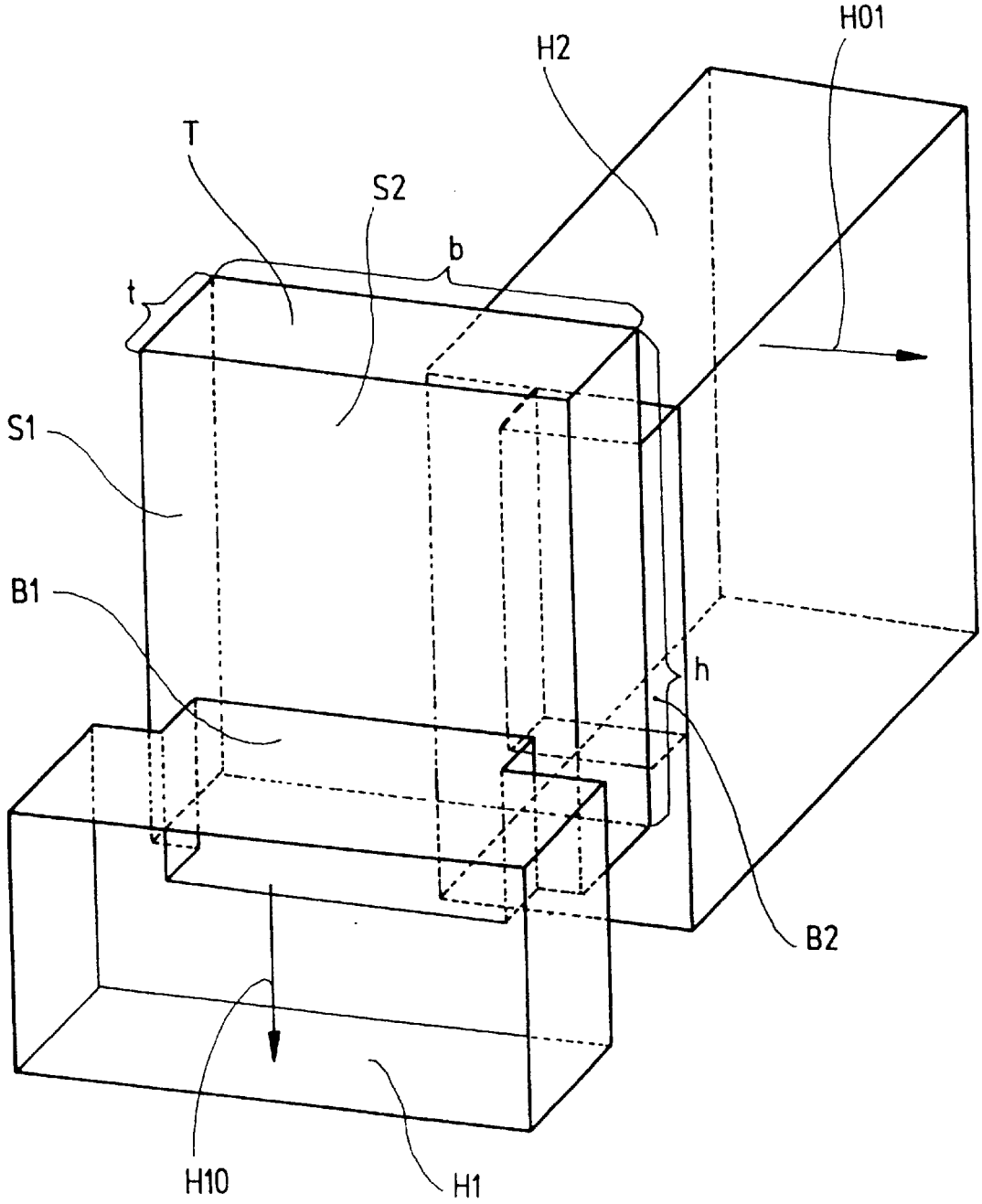
Figure 4:
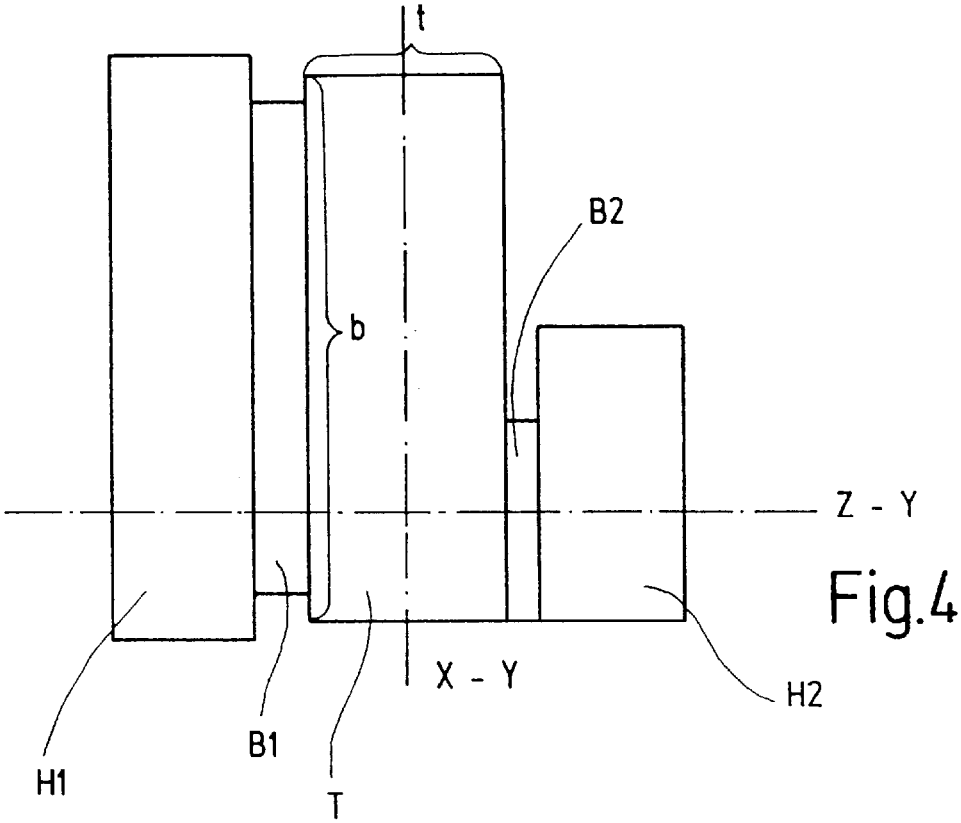
Figure 5:
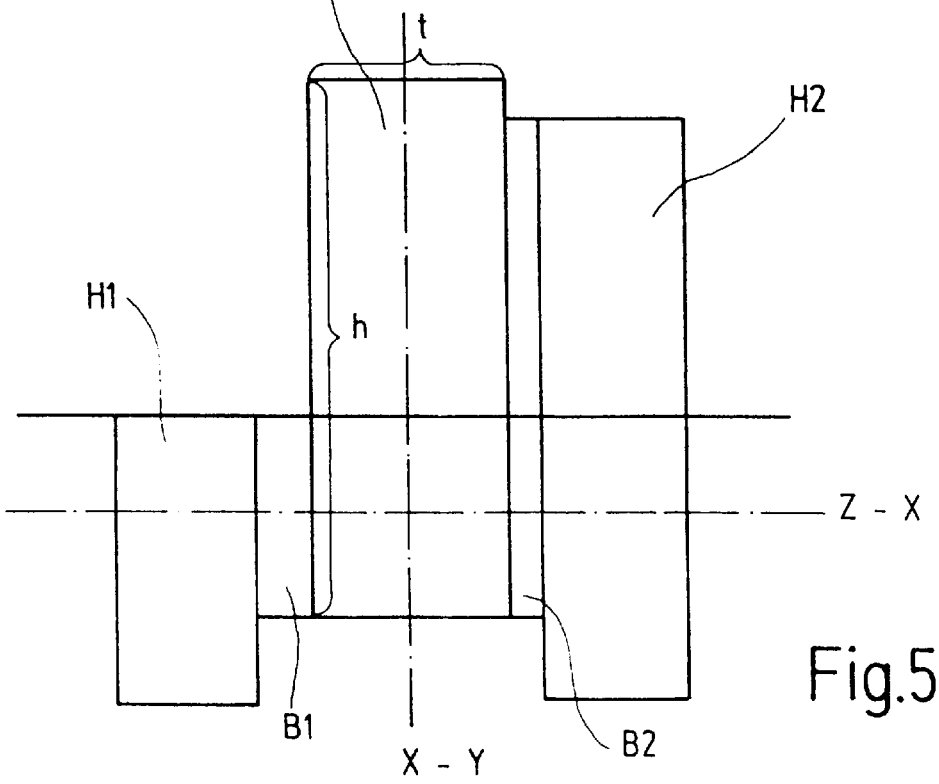
Figure 6:
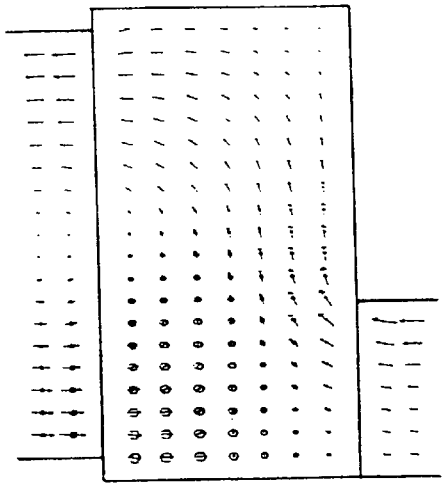
Figure 7:
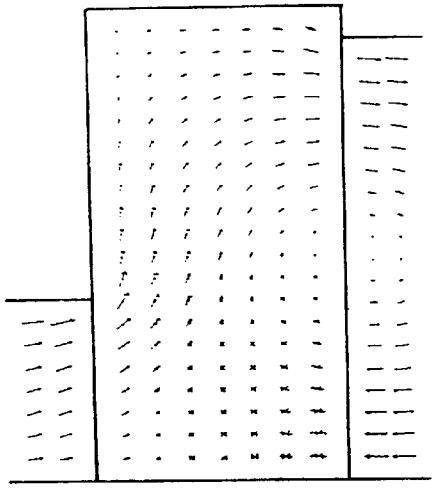
Figure 8:
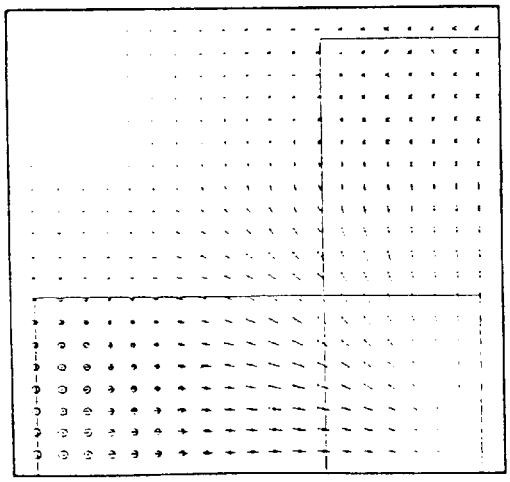

The figures show the following:

FIG. 1—a first implementation of the junction according to the invention;

FIG. 2—a second implementation of the junction according to the invention;

FIG. 3—a third implementation of the junction according to the invention;

FIG. 4—a top view of the junction according to FIG. 3;

FIG. 5—a side view of the junction according to FIG. 3;

FIG. 6—an image of the magnetic field in the junction according to FIG. 3, in a first sectional plane;

FIG. 7—an image of the magnetic field in the junction according to FIG. 3, in a second sectional plane;

FIG. 8—an image of the magnetic field in the junction according to FIG. 3, in a third sectional plane.

DETAILED DESCRIPTION OF PREFERRED EMBODIMENTS

FIG. 1 shows a single-stage implementation of a junction for orthogonally oriented waveguides H1, H2. The junction includes a transformation stage T, which has essentially right-angled geometry. The height of the transformation stage T is designated by h, its width by b and its depth with t. The transformation stage T has a first oblong opening for connecting a first waveguide H1, which is designed to carry a first ground wave type H10. The height h and the width b of the transformation stage T are chosen such that both the first ground wave type H10 and the second ground wave type H01 can be propagated in the transformation stage T. In the case illustrated, the length or depth t of the transformation stage T is chosen such that the relationship $t \leqq (2n+1)\lambda/4$, with n=0, 1, 2, 3 . . . . Here $\lambda$ is the waveguide wavelength of the H10 or of the H01 wave type in the area of the transformation stage T, preferably the mean waveguide wavelength of the useful frequency band. As shown in FIG. 1, the first oblong opening is located in the lower area of the front face S1 of the transformation stage T, and the length 11 of the first oblong opening corresponds to the width b of the transformation stage T. The second oblong opening is located in the right area of the rear face S2 of the transformation stage T, and the length 12 of the second oblong opening corresponds to the height h of the transformation stage T. Because of this asymmetrical arrangement of the first oblong opening and of the second oblong opening, or of the first waveguide Hi and of the second waveguide H2, a hybrid wave type is formed in the transformation stage T, which causes the transformation.

FIG. 2 shows a second two-stage implementation of the junction according to the invention. The transformation stage T has a first oblong opening for connecting a first waveguide H1, which is designed to carry a first ground wave type H10. The basic polarization orientation of the first ground wave type H10 is indicated in FIG. 2 by the corresponding arrow. In addition, the transformation stage T has a second oblong opening for connecting a second waveguide H2, which is designed to carry a second ground wave type H01. The basic polarization of the second ground wave type H01 is also shown in FIG. 2 by a corresponding arrow. The height h and the width b of the transformation stage T are chosen such that both the first ground wave type H10 and the second ground wave type H01 can be propagated in the transformation stage T. The length or depth t of the transformation stage T is preferably chosen such that the relationship $t \leqq (2n+1)\lambda/4$ is fulfilled, with n=0, 1, 2, 3 . . . , where $\lambda$ is the waveguide wavelength of the H10 or H01 wave type in the area of the transformation stage T, preferably the mean waveguide wavelength of the useful frequency band. The first oblong opening is located in the lower part of the front face S1 of the transformation stage T, and the width of the first opening in this implementation is somewhat smaller than the width b of the transformation stage T. The second oblong opening is located in the right part of the rear face S2 of the transformation stage T, and the length of the second oblong opening in the implementation illustrated in FIG. 2 corresponds to the height h of the transformation stage T. The first oblong opening and the second oblong opening are thus oriented orthogonally with respect to each other. In order to increase the bandwidth of the junction compared to the implementation illustrated in FIG. 1, the first waveguide H1 is not connected directly to the first oblong opening, but via an additional transformation stage T10. In the case illustrated, the width of the additional transformation stage T10 corresponds to the width of the first oblong opening; that is, it is somewhat smaller than the width b of the transformation stage T. Although this is not shown, implementations are conceivable in which the second waveguide H2 only or also is connected with the second oblong opening via a corresponding additional transformation stage.

FIGS. 3 to 5 show a third three-stage implementation of the junction according to the invention, with FIG. 3 showing a perspective schematic view, FIG. 4 a top view, and FIG. 5 a side view of the third implementation of the junction. The transformation stage T has a first oblong opening for connecting a first waveguide H1, which is designed to carry a first ground wave type H10. The basic polarization direction of this first ground wave type H10 is indicated in FIG. 3 by a corresponding arrow. In addition, the transformation stage T has a second oblong opening for connecting a second waveguide H2, which is designed to carry a second ground wave type H10. The basic direction of polarization of the second ground wave type H01 is also indicated in FIG. 3 by a corresponding arrow. In this implementation also, the transformation stage T has an essentially right-angled geometry, with a height h, a width b and a depth t. The height h and the width b here are chosen such that both the first ground wave type H10 and the second ground wave type H01 can be propagated in the transformation stage T. The length or depth t of the transformation stage T is chosen such that it fulfills the relation $t \leqq (2n+1)\lambda/4$, with n=0, 1, 2, 3 . . . , where λ is the waveguide wavelength of the H10 or of the H01 wave type in the area of the transformation stage T, preferably the mean waveguide wavelength of the useful frequency band. As can be seen in FIG. 3, the first oblong opening of the transformation stage T is located in the lower area of the front face S1 of the transformation stage T. The second oblong opening is located in the right area of the rear face S2 of the transformation stage T. The first oblong opening and the second oblong opening are thus aligned orthogonally with respect to each other. In order to increase the bandwidth of the junction according to the invention compared to the implementation in accordance with FIG. 1, the first waveguide H1 in the implementation illustrated in FIGS. 3 to 5 is not connected directly to the first oblong opening in the front face of the transformation stage T; instead, a first shield B1 is provided, through which the first waveguide H1 is connected with the first oblong opening. As can be seen on the basis of FIGS. 3 and 4, the width of the second opening and of the first shield B1 in this implementation is chosen such that it is somewhat smaller than the width b of the transformation stage T. The second waveguide H2 in this implementation is also not connected directly to the second oblong opening in the right area of the rear face S2 of the transformation stage T; instead, a second shield B2, which is connected to the second oblong opening, connects the second waveguide H2 with the second oblong opening. As can be seen in particular on the basis of FIGS. 3 and 4, the width of the second oblong opening and the width of the second shield B2 is chosen such that it is somewhat smaller than the height h of the transformation stage T. In contrast to the manner of connecting the first waveguide H1, the second waveguide H2 is connected to the second shield B2 asymmetrically in this implementation, although this would not be absolutely necessary. In reference to the third implementation illustrated in FIGS. 3 to 5 it can be stated in summary that the first shield B1 and the second shield B2 are positioned asymmetrically on the transformation stage T, in such a way that the first shield B1 is positioned at the lower edge of the front face S1 and the second shield B2 is positioned at the right edge of the rear face S2. The length of the waveguide segment T in the case illustrated is somewhat shorter than λ/4 of the mean waveguide wavelength of the useful frequency band. This construction of the junction causes a hybrid wave type to form in the transformation stage T, which brings about the transformation between the orthogonal H10 and H01 wave types. With the implementation illustrated in FIGS. 3 to 5, it is possible to achieve a reflection characteristic with a Chebyshev pattern having three zero positions, so as to realize the correspondingly large useful bandwidth. Essential to the functioning of the junction is the asymmetry of the first shield B1 with respect to the height h and that of the second shield B2 with respect to the width b of the transformation stage T. Asymmetry in the other respective cross sectional dimension is possible, as is illustrated, for example, for the second shield B2, but is not necessary. The illustrated symmetry of the second shield B2 with respect to the second waveguide H2 is also not absolutely necessary, as was mentioned earlier.

FIGS. 6 to 8 show images of magnetic fields which occur at various sectional planes of the third implementation of the junction according to the invention, illustrated in FIGS. 3 to 5. Here the magnetic field image shown in FIG. 6 occurs in the plane Z-X, which is sketched into FIG. 5. The magnetic field image shown in FIG. 7 occurs along the plane Z-Y sketched into FIG. 4, and the magnetic field image shown in FIG. 8 occurs in the X-Y plane, which is sketched into both FIG. 4 and FIG. 5. In FIGS. 6 to 8, the field rotation achieved by the hybrid wave type generated in the transformation stage T can be clearly recognized.

Common to the three implementations illustrated is the fact that they can be integrated into planar waveguide circuits, and can be produced, for example, by milling. Despite their short basic lengths, very good electrical properties are achieved across a very wide range of frequencies, as mentioned earlier.

The features of the invention revealed in the above description, in the drawings and in the claims can be significant for the realization of the invention both individually and in any combination.

What is claimed is:

1. A junction for joining orthogonally oriented waveguides, comprising: a transformation stage having a first oblong opening for connecting a first of the waveguides for carrying a first wave type, and a second oblong opening for connecting a second of the waveguides for carrying a second wave type, the first oblong opening and the second oblong opening being oriented orthogonally with respect to each other, the transformation stage having a height, a width, and a depth, the height and the width being chosen such that both the first wave type and the second wave type are propagated in the transformation stage, the first oblong opening being located in a front face of the transformation stage, the second oblong opening being located in a rear face of the transformation stage, and the first oblong opening being positioned horizontally in an upper or lower area of the front face of the transformation stage.

2. A junction for joining orthogonally oriented waveguides, comprising: a transformation stage having a first oblong opening for connecting a first of the waveguides for carrying a first wave type, and a second oblong opening for connecting a second of the waveguides for carrying a second wave type, the first oblong opening and the second oblong opening being oriented orthogonally with respect to each other, the transformation stage having a height, a width, and a depth, the height and the width being chosen such that both the first wave type and the second wave type are propagated in the transformation stage, the first oblong opening being located in a front face of the transformation stage, the second oblong opening being located in a rear face of the transformation stage, and the second oblong opening being positioned vertically in a left or right area of the rear face of the transformation stage.

3. A junction for joining orthogonally oriented waveguides, comprising: a transformation stage having a first oblong opening for connecting a first of the waveguides for carrying a first wave type, and a second oblong opening for connecting a second of the waveguides for carrying a second wave type, the first oblong opening and the second oblong opening being oriented orthogonally with respect to each other, the transformation stage having a height, a width, and a depth, the height and the width being chosen such that both the first wave type and the second wave type are propagated in the transformation stage, the first oblong opening being connected to an additional transformation stage for connecting the first waveguide, and the additional transformation stage having a width that is smaller than the width of the transformation stage.

4. A junction for joining orthogonally oriented waveguides, comprising: a transformation stage having a first oblong opening for connecting a first of the waveguides for carrying a first wave type, and a second oblong opening for connecting a second of the waveguides for carrying a second wave type, the first oblong opening and the second oblong opening being oriented orthogonally with respect to each other, the transformation stage having a height, a width, and a depth, the height and the width being chosen such that both the first wave type and the second wave type are propagated in the transformation stage, the first oblong opening being connected to a first shield for connecting the first waveguide, and the first shield having a width that is smaller than the width of the transformation stage.

5. A junction for joining orthogonally oriented waveguides, comprising: a transformation stage having a first oblong opening for connecting a first of the waveguides for carrying a first wave type, and a second oblong opening for connecting a second of the waveguides for carrying a second wave type, the first oblong opening and the second oblong opening extending along respective axes which are oriented orthogonally with respect to each other for coupling the first and second wave types between the first and second waveguides, the first and second oblong openings having smaller cross-sections than those of the first and second waveguides, the transformation stage having a height, a width, and a depth, the height and the width being chosen such that both the first wave type and the second wave type are propagated in the transformation stage, the dept $\leqq(2n+1)\lambda/4$, with n=0, 1, 2, 3 . . . , where X is the waveguide wavelength of one of the first wave type and of the second wave type in the transformation stage.

6. The junction in accordance with claim 5, wherein the first oblong opening is located in a front face of the transformation stage, and wherein the second oblong opening is located in a rear face of the transformation stage.

7. The junction in accordance with claim 5, wherein the first oblong opening has a length that corresponds approximately to the width of the transformation stage.

8. The junction in accordance with claim 5, wherein the second oblong opening has a length that corresponds approximately to the height of the transformation stage.

9. The junction in accordance with claim 5, wherein the first oblong opening is connected to an additional transformation stage for connecting the first waveguide.

10. The junction in accordance with claim 9, wherein the additional transformation stage is arranged symmetrically with respect to a cross-section of the first waveguide and asymmetrically with respect to the transformation stage.

11. The junction in accordance with claim 5, wherein the first oblong opening is connected to a first shield having an opening smaller in cross-section than the first oblong opening for connecting the first waveguide.

12. The junction in accordance with claim 11, wherein the second oblong opening is connected with a second shield having an opening smaller in cross-section than the second oblong opening for connecting the second waveguide.

13. The junction in accordance with claim 12, wherein the second shield has a width that is smaller than the height of the transformation stage.

14. The junction accordance with claim 5, wherein the transformation stage is produced by a milling machine.

15. The junction in accordance with claim 5, wherein the transformation stage is constituted of an integrated waveguide circuit, or a component thereof.

16. The junction in accordance with claim 5, wherein the first waveguide and the second waveguide have different cross-sections.

* * * * *